US008105215B2

(12) United States Patent
Wang

(10) Patent No.: US 8,105,215 B2
(45) Date of Patent: Jan. 31, 2012

(54) PULL CORD ASSEMBLY FOR BODY STRETCHING EXERCISE

(75) Inventor: Wen-Ching Wang, Taichung Hsien (TW)

(73) Assignee: Wen-Ching Wang, Taichung Hsien (TW)

( * ) Notice: Subject to any disclaimer, the term of this patent is extended or adjusted under 35 U.S.C. 154(b) by 0 days.

(21) Appl. No.: 12/603,006

(22) Filed: Oct. 21, 2009

(65) Prior Publication Data

US 2010/0255964 A1 Oct. 7, 2010

(30) Foreign Application Priority Data

Apr. 3, 2009 (TW) ..... 98111203 A

(51) Int. Cl.
*A63B 21/02* (2006.01)
*A44B 13/02* (2006.01)

(52) U.S. Cl. ..... 482/121; 482/126; 24/300

(58) Field of Classification Search ..... 482/49, 482/82, 121, 122, 126, 128; 87/6, 9; 57/225
See application file for complete search history.

(56) References Cited

U.S. PATENT DOCUMENTS

| | | | | |
|---|---|---|---|---|
| 2,865,978 | A * | 12/1958 | Modrey | 174/69 |
| 2,887,005 | A * | 5/1959 | Fromm | 87/1 |
| 4,022,009 | A * | 5/1977 | van Assendelft | 57/212 |
| 4,563,869 | A * | 1/1986 | Stanton | 57/211 |
| 4,640,178 | A * | 2/1987 | Kurzbock | 87/6 |
| 4,777,784 | A * | 10/1988 | Ferguson | 54/34 |
| 5,205,803 | A * | 4/1993 | Zemitis | 482/121 |
| 5,681,248 | A * | 10/1997 | Vani | 482/126 |
| 5,800,322 | A * | 9/1998 | Block | 482/126 |
| 6,202,263 | B1 * | 3/2001 | Harker | 24/300 |
| 7,740,570 | B2 * | 6/2010 | Winston | 482/121 |
| 7,794,374 | B1 * | 9/2010 | Park | 482/122 |
| 2006/0160679 | A1 * | 7/2006 | Kung | 482/121 |
| 2007/0015643 | A1 * | 1/2007 | Kung | 482/126 |
| 2007/0155600 | A1 * | 7/2007 | Cunningham et al. | 482/126 |

* cited by examiner

*Primary Examiner* — Stephen Crow
(74) *Attorney, Agent, or Firm* — Banner & Witcoff, Ltd.

(57) ABSTRACT

A pull cord assembly for body stretching exercise includes an elastic cord member and a strand-like protective member. The elastic cord member has an elastic cord body which extends along a lengthwise axis to terminate at two anchored ends. The strand-like protective member has a strand-like body which extends lengthwise to terminate at two coupled ends that are secured with the anchored ends, respectively. The strand-like body is twined around the elastic cord body along the lengthwise axis so as to enhance the safety of using the pull cord assembly.

21 Claims, 22 Drawing Sheets

PULL CORD ASSEMBLY FOR BODY STRETCHING EXERCISE

CROSS-REFERENCE TO RELATED APPLICATION

This application claims priority of Taiwanese patent Application No. 098111203, filed on Apr. 3, 2009, the disclosure of which is herein incorporated by reference.

BACKGROUND OF THE INVENTION

1. Field of the Invention

This invention relates to a pull cord assembly, more particularly to a pull cord assembly having a protective member for body stretching exercise.

2. Description of the Related Art

A conventional pull cord assembly for body stretching exercise generally includes an elastic cord made of elastic material, such as latex rubber, TPR (thermoplastic resin), etc. As such, the elastic cord will become brittle over time, especially at bent portions thereof. If the elastic cord breaks when being stretched, the user may be in danger of being hit by the broken cord. Referring to FIG. 1, a conventional pull cord assembly 1 is shown to include a protective sleeve 12 which is formed by knitted nylon yarns and which is sleeved on an elastic cord body 11. If the cord body 11 accidentally breaks, the broken cord body 11 can be enclosed in the sleeve 12, thereby preventing the broken cord body 11 from flying about and hurting the user. However, the broken cord body 11 may snap back along a tubular space defined by the sleeve 12 and hit the user's hands. Moreover, since the nylon sleeve 12 is not flexible and has a length much longer than that of the elastic cord body 11 so as to permit sufficient stretching of the elastic cord body 11, the sleeve 12 has many irregular folds in a normal state, which adversely affects the outer appearance of the cord assembly 1, and which renders use of the cord assembly 1 with other body exercising devices troublesome.

In a co-pending U.S. patent application Ser. No. 12/271,150, entitled "Safety Elastic Rope," filed by the applicant, there is disclosed a safety elastic rope which includes an elastic outer tubular rope having two longitudinally opposite first fixing ends, and an elastic inner rope inserted into the outer tubular rope having two longitudinally opposite second fixing ends connected respectively to the first fixing ends.

SUMMARY OF THE INVENTION

An object of the present invention is to provide a pull cord assembly for body stretching exercise, which is safe to use and which has a sufficient stretching strength to meet a user's requirement.

According to this invention, the pull cord assembly includes an elastic cord member and a strand-like protective member. The elastic cord member has an elastic cord body which extends along a lengthwise axis to terminate at first and second anchored ends, and which has an outer layer that surrounds the lengthwise axis and that has upper and lower halves. The strand-like protective member has a strand-like body which extends lengthwise to terminate at a first coupled end that is secured with the first anchored end to form a secured first end pair, and a second coupled end that is secured with the second anchored end to form a secured second end pair. The strand-like body has a plurality of first segments which are respectively displaced from one another along a lengthwise length of the strand-like body, and a plurality of second segments which are displaced from one another along the lengthwise length. Each of the first segments is alternately disposed with a respective one of the second segments. The strand-like body is configured to be twined around the elastic cord body along the lengthwise axis such that the first and second segments are respectively disposed on the upper and lower halves, such that the first segments are displaced from one another along the lengthwise axis, and such that the second segments are displaced from one another along the lengthwise axis. When the elastic cord body is subjected to a stretching force, the first and second segments are pulled and straightened along the lengthwise axis, thereby bringing the first and second segments to tightly abut against the upper and lower halves, respectively.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
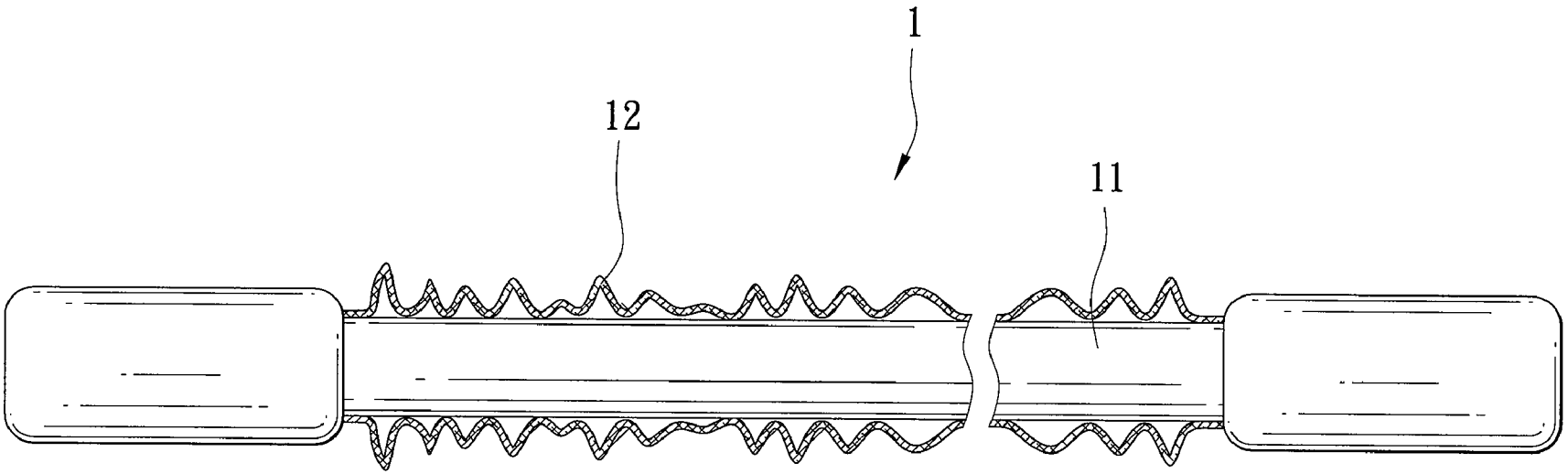
FIG. 1 PRIOR ART
FIG. 1 is a fragmentary sectional view of a conventional pull cord assembly in a normal state.

Before the present invention is described in greater detail, it should be noted that same reference numerals have been used to denote like elements throughout the specification.

Figure 2:
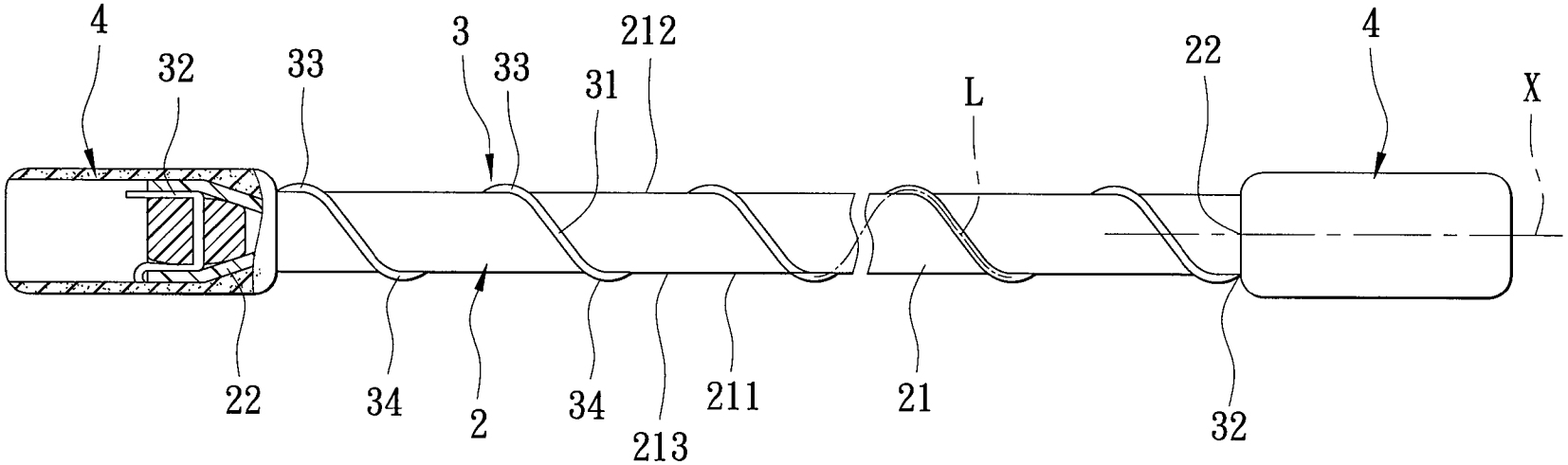
FIG. 2 is a fragmentary, partly sectional view of the first preferred embodiment of a pull cord assembly according to this invention.

Referring to FIG. 2, the preferred embodiment of a pull cord assembly according to the present invention is shown to comprise an elastic cord member 2, a strand-like protective member 3, and first and second connector subassemblies 4.

The elastic cord member 2 has an elastic cord body 21 which extends along a lengthwise axis (X) to terminate at first and second anchored ends 22, and which has an outer layer 211 that surrounds the lengthwise axis (X) and that has upper and lower halves 212,213 opposite to each other relative to the lengthwise axis (X). The elastic cord body 21 is stretchable along the lengthwise axis (X) between a non-stretched state, where the elastic cord body 21 has a normal length, and a stretched state, where the elastic core body 21 has an extended length.

The strand-like protective member 3 has a strand-like body 31 which extends lengthwise to terminate at a first coupled end 32 that is secured with the first anchored end 22 to forma secured first end pair, and a second coupled end 32 that is secured with the second anchored end 22 to form a secured second end pair. The strand-like body 31 has a plurality of first segments 33 which are displaced from one another along a lengthwise length (L) of the strand-like body 31, and a plurality of second segments 34 which are displaced from one another along the lengthwise length (L). The first and second segments 33,34 are interconnected in a continuous manner such that the strand-like body 31 has a single-piece construction. Each of the first segments 33 is alternately disposed with a respective one of the second segment 34. The strand-like body 31 is configured to be twined around the elastic cord body 21 along the lengthwise axis (X) such that the first segments 33 are disposed on the upper half 212 and the second segments 34 are disposed on the lower half 213. In addition, the first segments 33 are displaced from one another along the lengthwise axis (X), and the second segments 33 are displaced from one another along the lengthwise axis (X). When the elastic cord body 21 is subjected to a stretching force, the first and second segments 33,34 are pulled and straightened along the lengthwise axis (X), thereby bringing the first and second segments 33,34 to tightly abut against the upper and lower halves 212,213, respectively.

The strand-like body 31 is thinner than the elastic cord body 21, and is twined around the elastic cord body 21 to permit the lengthwise length (L) to extend in a spiral path that surrounds the lengthwise axis (X). The elastic cord body 21 may be made from an elastic material, such as latex rubber, rubber, synthetic rubber (e.g., TPE, SEBS, etc.), TPU, TPR, and the like. Alternatively, the elastic cord body 21 may be made from a non-elastic material, such as PP, PE, Tetoron, nylon, PVC, polyester fiber, polymer, and the like, or may be in the form of a tension spring.

The strand-like body 31 made from an elastic material has a normal strand length when the elastic core body 21 is in the non-stretched state, which can be smaller than the normal length of the elastic core body 21. That is, the strand-like body 31 is twined around the outer layer 211 of the elastic cord body 21 and is in a tensed state. It is noted that the normal strand length of the strand-like body 31 may be greater than the normal length of the elastic cord body 21.

Figure 3:
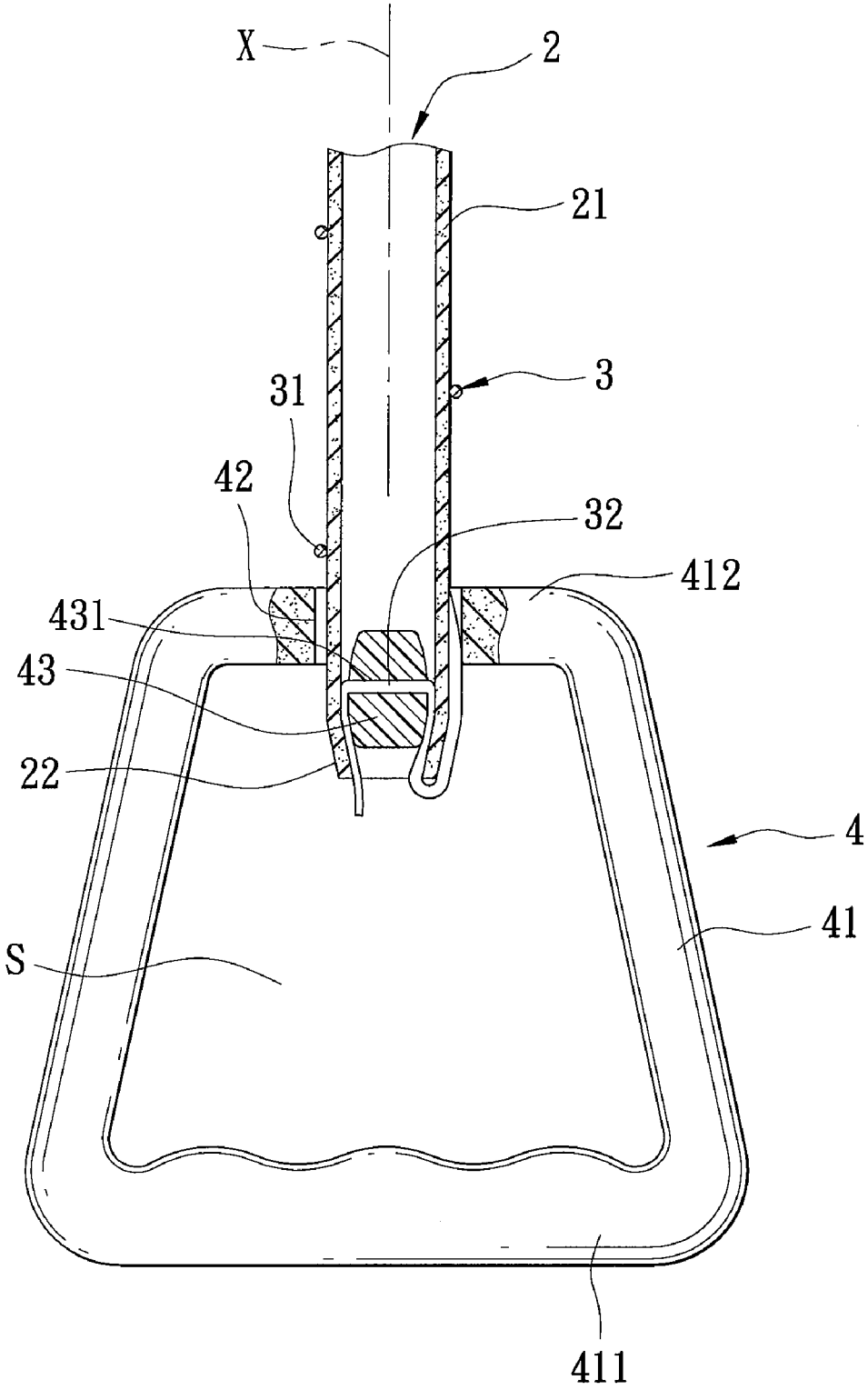
FIG. 3 is a fragmentary, partly sectional view of a portion of the first preferred embodiment.

The first connector subassembly 4 is disposed to secure the first coupled end 32 to the first anchored end 22. The second connector subassembly 4 is disposed to secure the second coupled end 32 to the second anchored end 22. As shown in FIG. 3, in this embodiment, each of the first and second connector subassemblies 4 includes a handgrip 41 which has a handgrip bar 411 disposed distal from a respective one of the first and second end pairs 22,32, and a crosspiece 412 spaced apart from the handgrip bar 411 along the lengthwise axis (X) by a handgrip space (S). The crosspiece 412 has a through hole unit 42 which extends along the lengthwise axis (X) and which is configured to permit the strand-like body 21 and the elastic cord body 31 to pass therethrough such that the respective one of the first and second end pairs 22,32 is disposed in the handgrip space (S). Each of the first and second connector subassemblies 4 further includes a plug 43 which is configured to be fitted snugly in a respective one of the first and second anchored ends 22 such that the respective one of the first and second anchored ends 22 is enlarged to guard against movement of the respective one of the first and second end pairs 22,32 away from the handgrip space (S).

Figure 4:
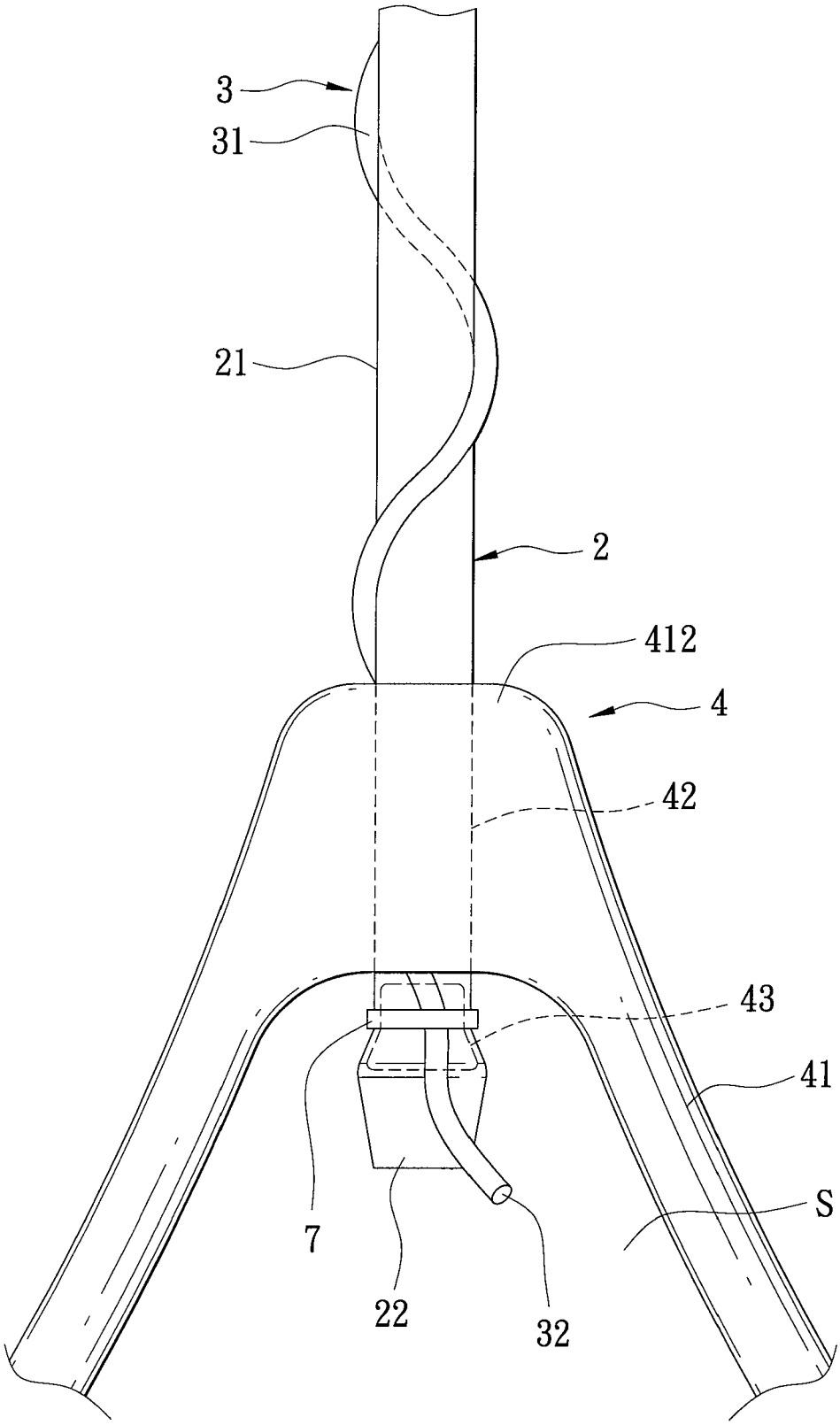
FIG. 4 is a fragmentary schematic view showing a connector of the first preferred embodiment in a modified form.
Figure 5:
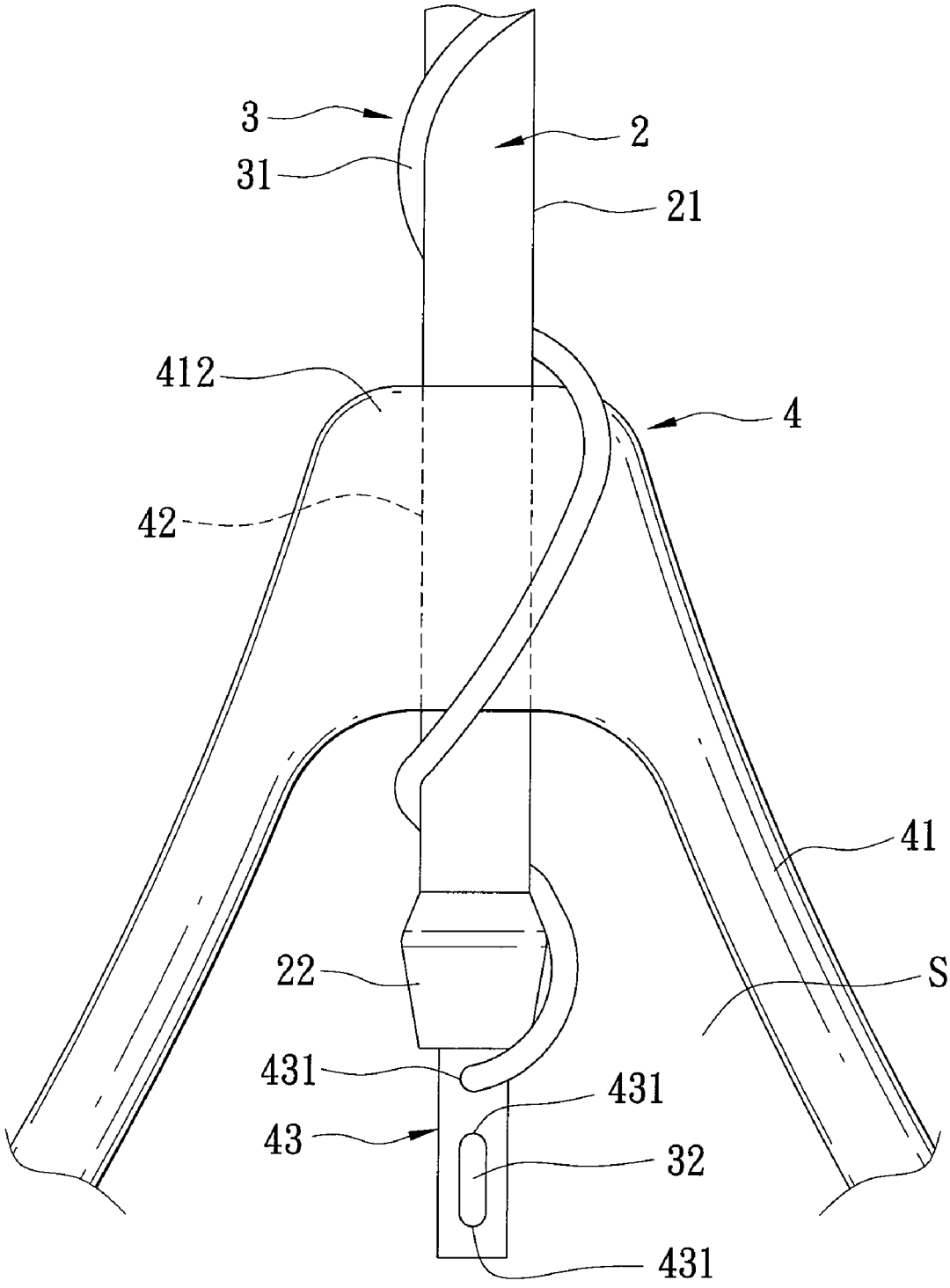
FIG. 5 is a fragmentary schematic view showing the connector of the first preferred embodiment in another modified form.
Figure 6:
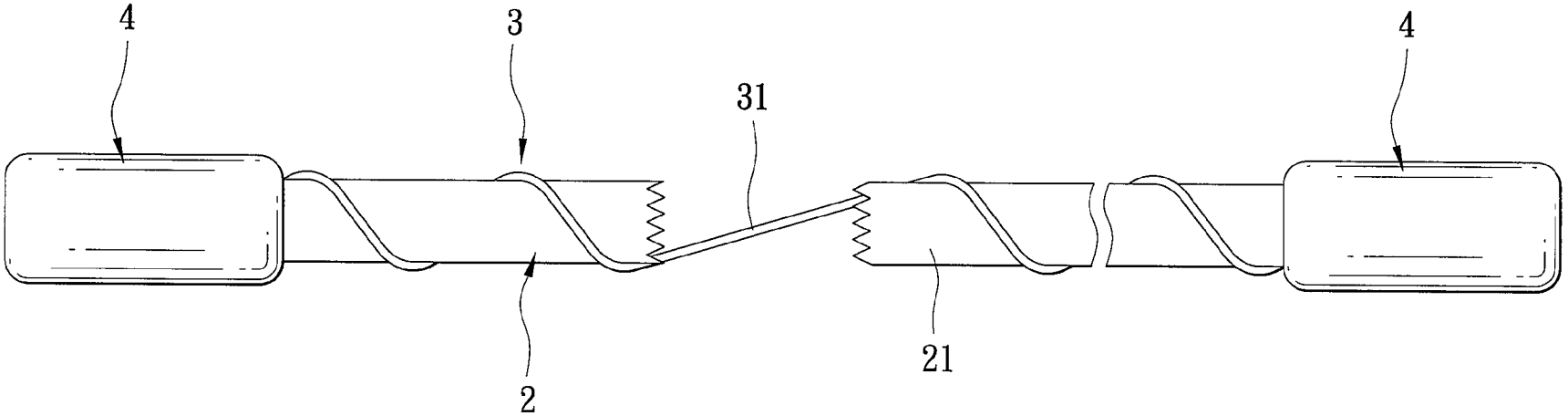
FIG. 6 is a schematic view showing an elastic cord member of the first preferred embodiment in a broken state.

In the embodiment as shown in FIG. 3, the plug 43 has a fastening hole 431 for securing a respective one of the first and second coupled ends 32. Alternatively, as shown in FIG. 4, each of the first and second connector subassemblies 4 includes a tying band 7 which is disposed to fasten a respective one of the first and second coupled ends 32 onto the respective one of the first and second anchored ends 22. Alternatively, as shown in FIG. 5, the plug 43 has a plurality of fastening holes 431, and each of the first and second coupled ends 32 is threaded through the fastening holes 431 after passing over the respective one of the first and second anchored ends 22.

Therefore, in case the elastic cord body 21 snaps into two pieces when being stretched, each piece of the elastic cord body 21 will snap back from the breaking point toward the respective one of the first and second connector subassemblies 4 and moves in a spiral fashion, thereby slowing down the movement of the snapped elastic cord body 21 and reducing the impact of the snapping of the elastic cord body 21 on the user.

Figure 7:
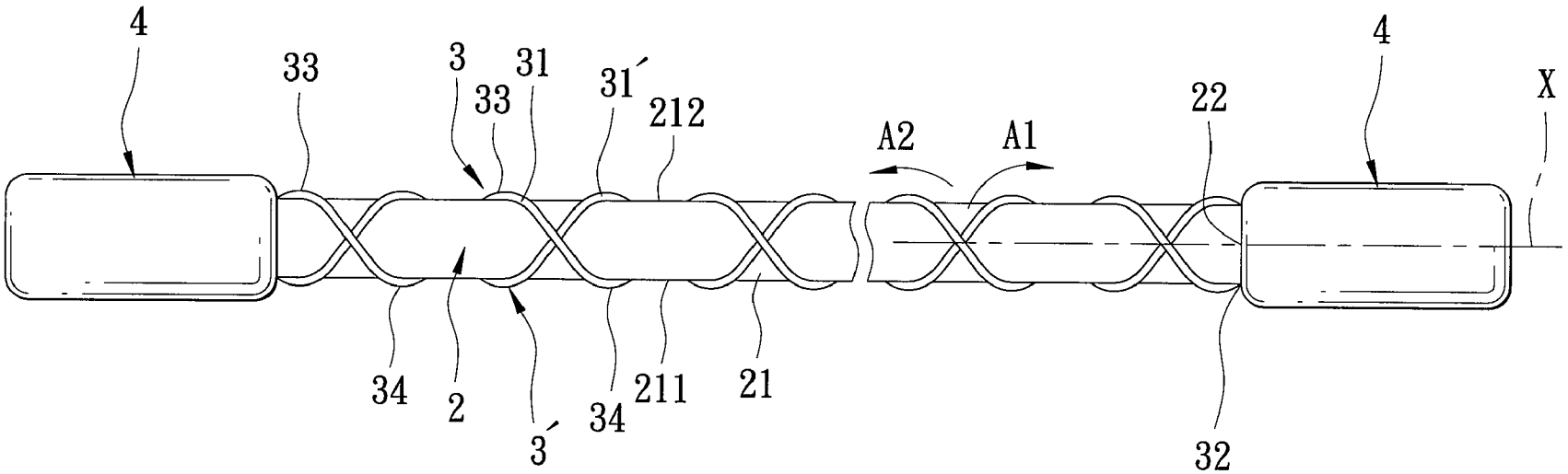
FIG. 7 is a fragmentary schematic view of the second preferred embodiment of a pull cord assembly according to this invention.

Referring to FIG. 7, the second preferred embodiment of a pull cord assembly according to this invention is similar to the first embodiment in construction. In the second embodiment, the pull cord assembly further comprises an auxiliary strand-like protective member 3' having a structure that is the same as that of the strand-like protective member 3. Specifically, the auxiliary strand-like protective member 3' has an auxiliary strand-like body 31' which is disposed to be twined around the elastic cord body 21 of the elastic cord member 2 along a secondary spiral path (A2) that surrounds the lengthwise axis (X) and that is opposite to the spiral path (A1) of the strand-like body 31 of the strand-like protective member 3.

Figure 8:
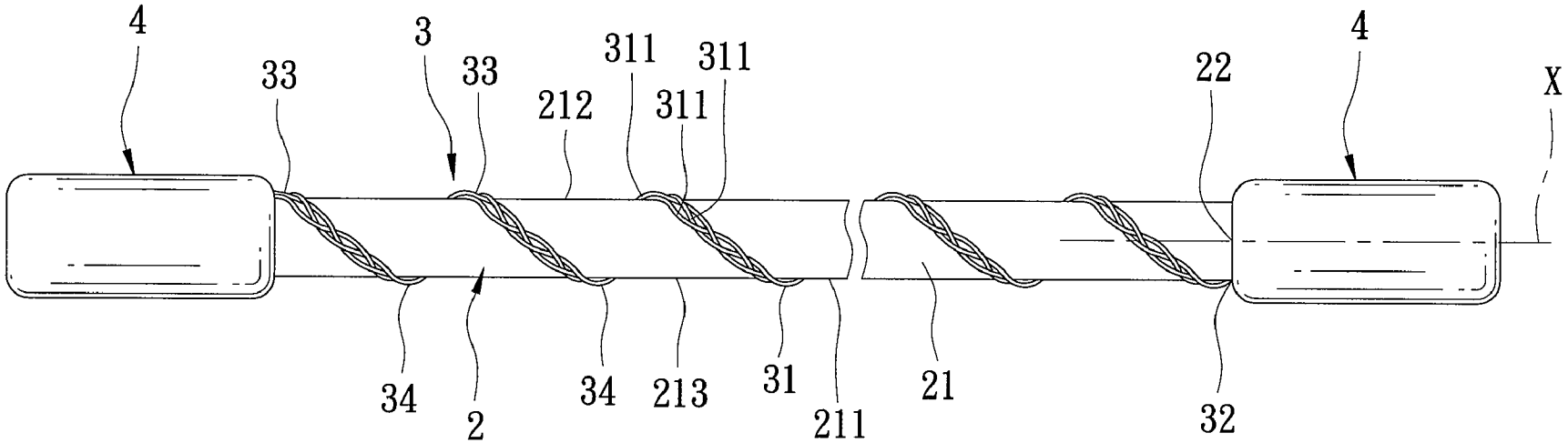
FIG. 8 is a fragmentary schematic view of the third preferred embodiment of a pull cord assembly according to this invention.

Referring to FIG. 8, the third preferred embodiment of a pull cord assembly according to this invention is similar to the first embodiment in construction. In the third embodiment, the strand-like body 31 includes three strands 311 which are intertwined together.

Figure 9:
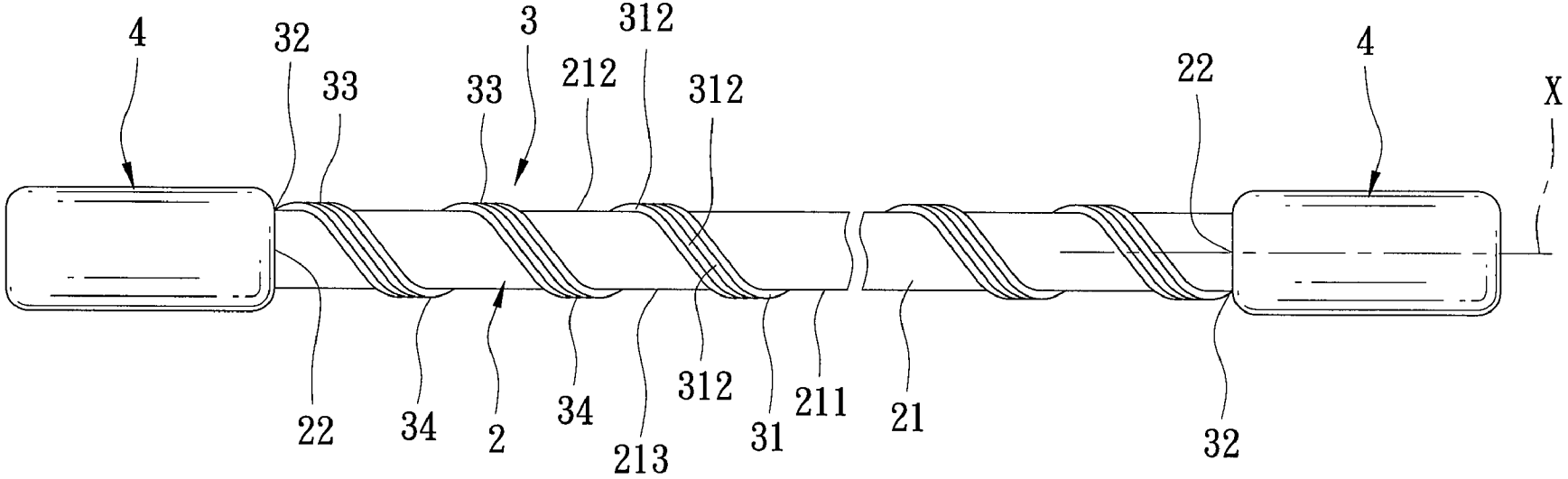
FIG. 9 is a fragmentary schematic view of the fourth preferred embodiment of a pull cord assembly according to this invention.

Referring to FIG. 9, the fourth preferred embodiment of a pull cord assembly according to this invention is similar to the first embodiment in construction. In the fourth embodiment, the strand-like body 31 includes a plurality of strands 312 that are arranged parallel to each other.

Figure 10:
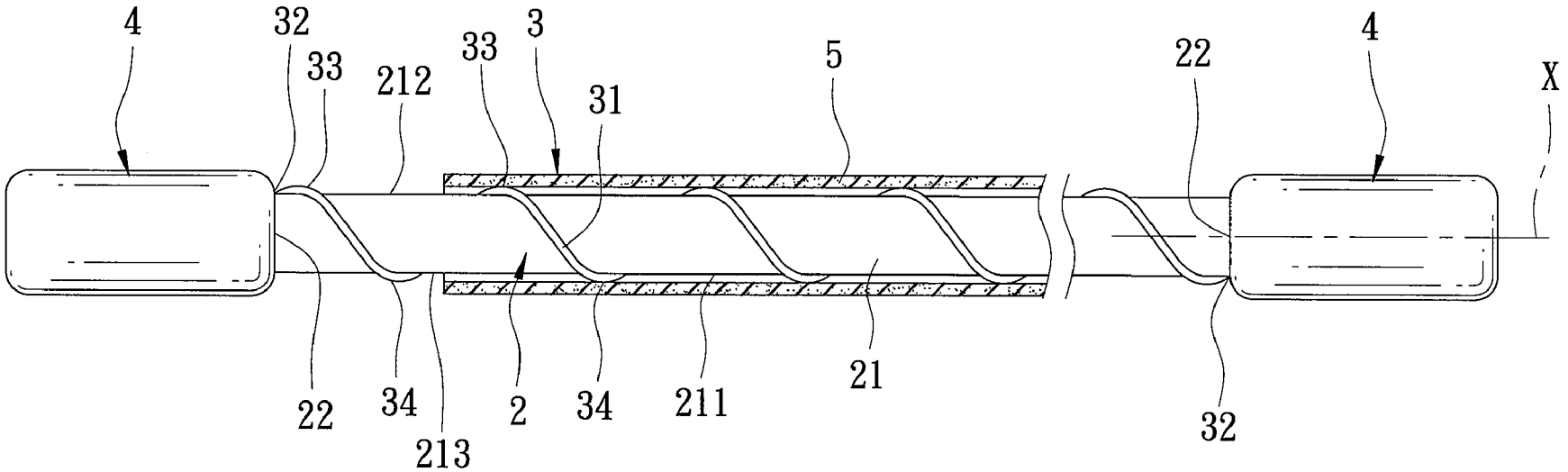
FIG. 10 is a fragmentary, partly sectional view of the fifth preferred embodiment of a pull cord assembly according to this invention.
Figure 11:
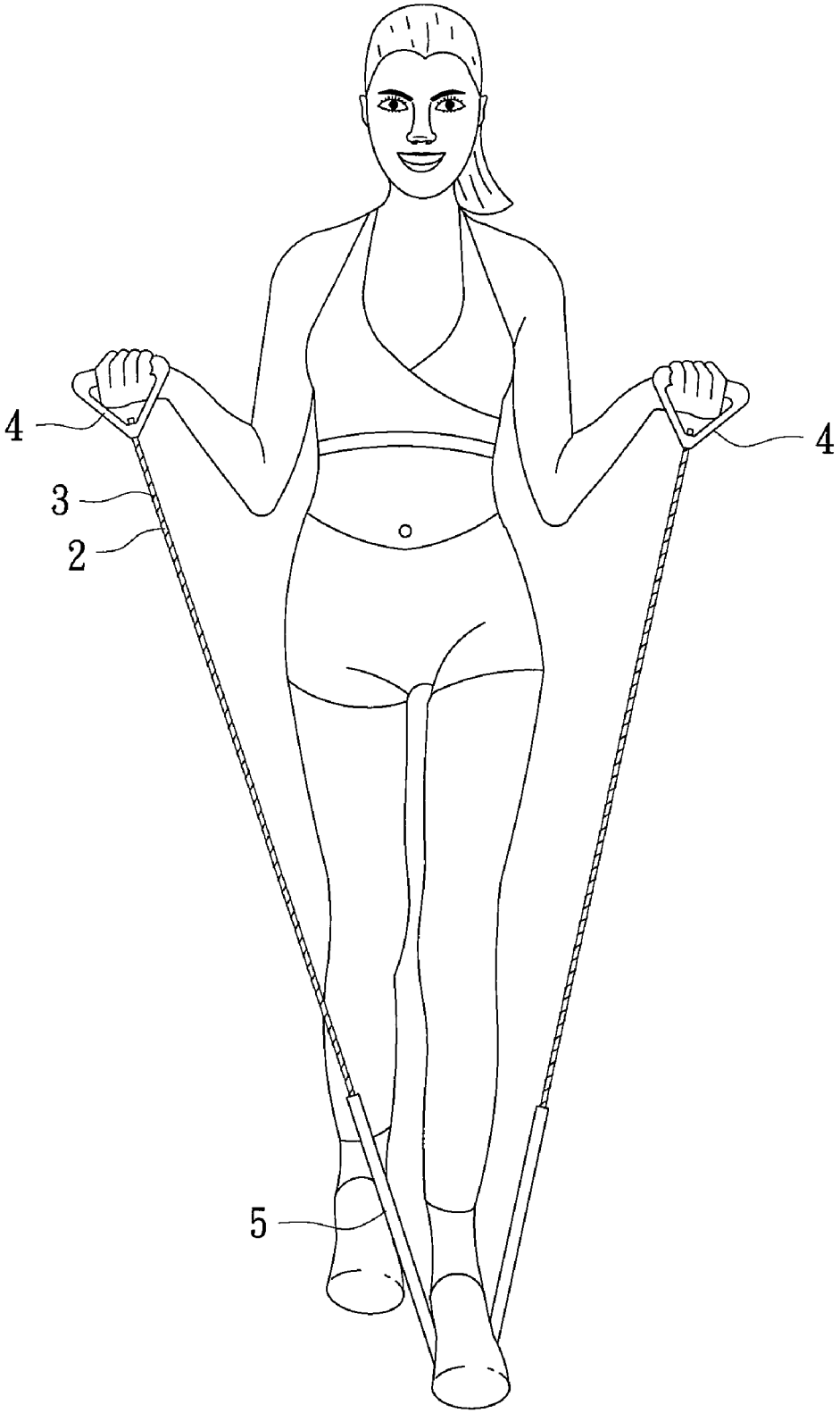
FIGS. 11 to 13 are schematic views showing the pull cord assembly of this invention in different states of use.

Referring to FIG. 10, the fifth preferred embodiment of a pull cord assembly according to this invention is similar to the first embodiment in construction. In the fifth embodiment, the pull cord assembly further comprises a protective sleeve 5 which is shiftably sleeved on the strand-like body 31 so as to further reduce the impact of the broken elastic cord body 21 on the user. In use, referring to FIG. 11, the user can place a foot on the protective sleeve 5, grip the first and second connector subassemblies 4 with both hands, and pull upwardly to perform a stretching exercise routine. The protective sleeve 5 can protect the strand-like body 31 from wearing.

Figure 12:
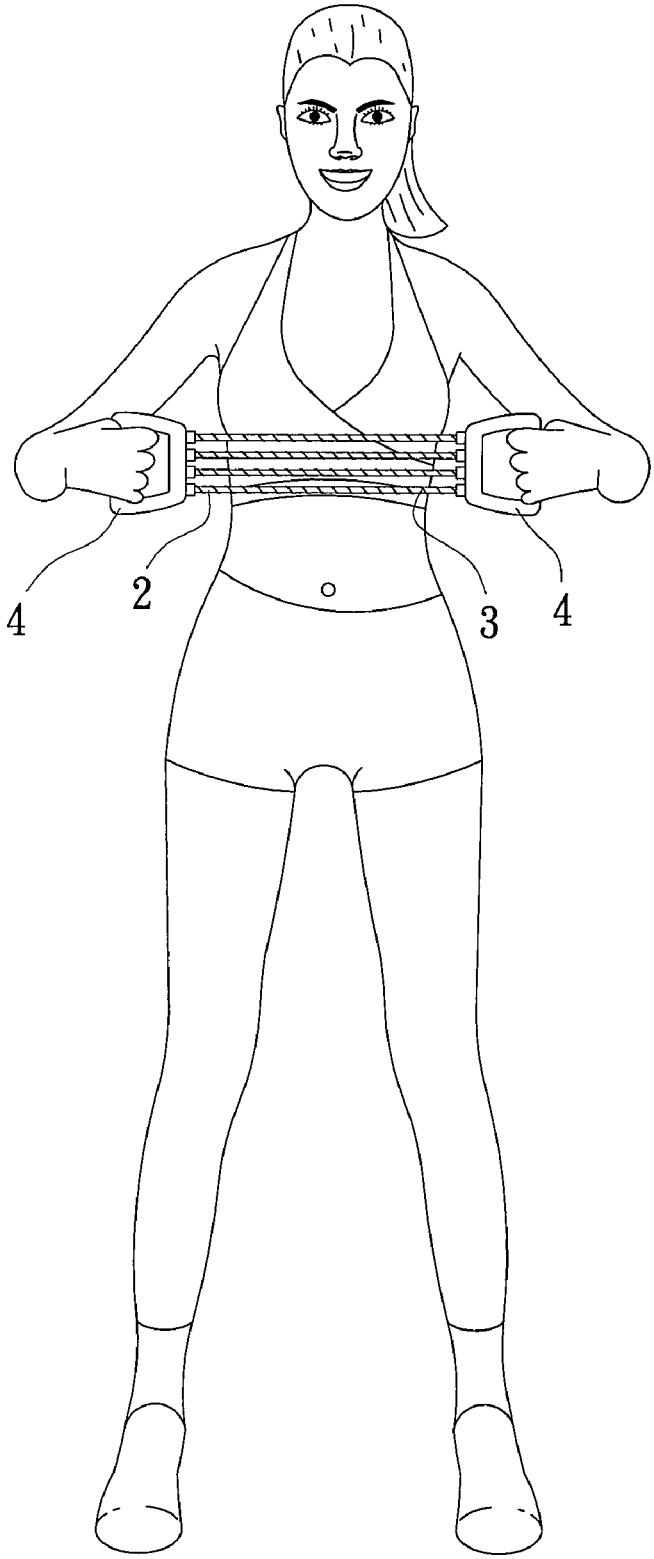
Figure 13:
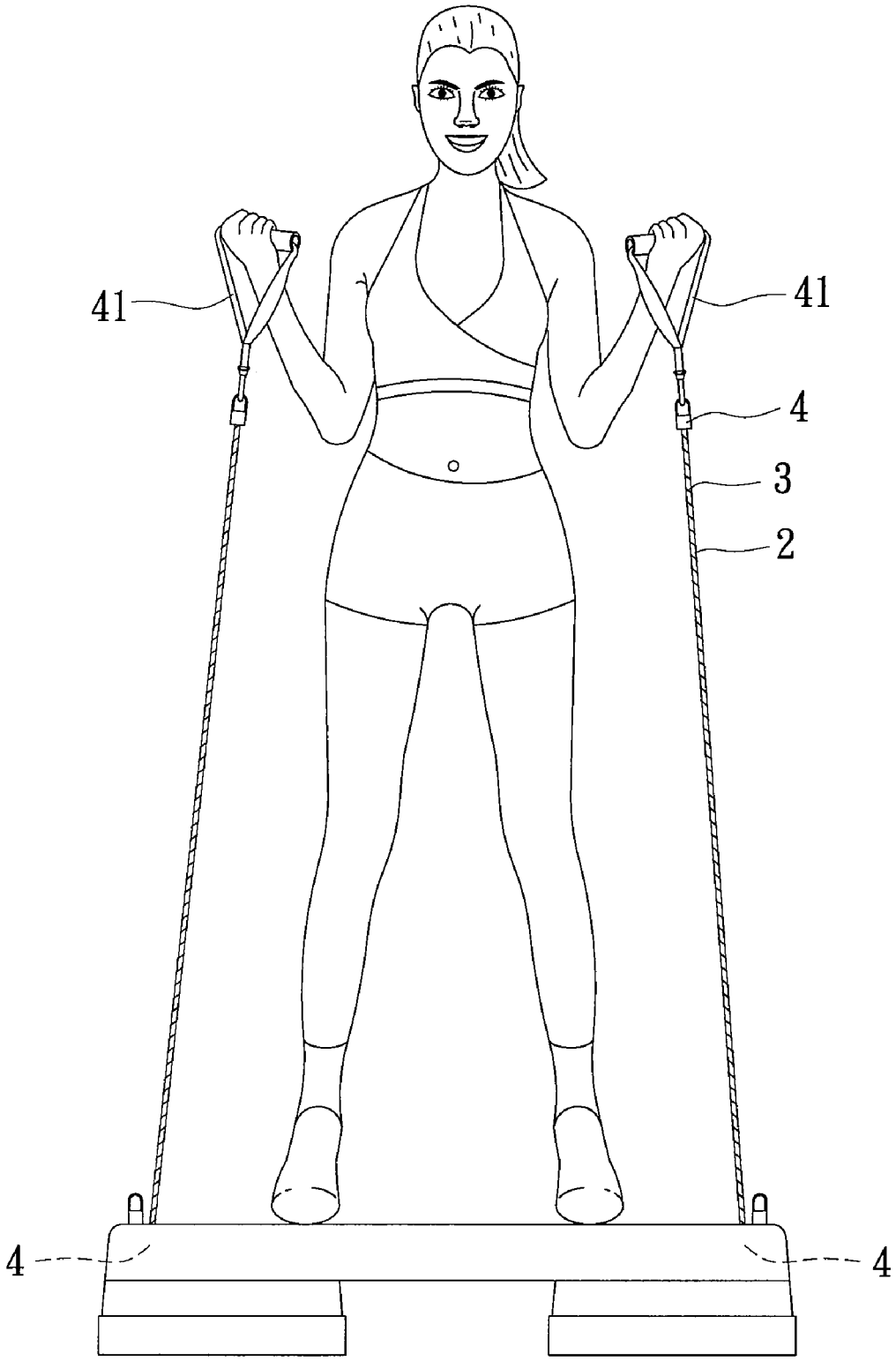

The pull cord assembly according to this invention may be used with different exercising devices. For example, the pull cord assembly is formed as a chest pull type exerciser such as that shown in FIG. 12. Referring to FIG. 13, the first connector subassembly 4 of the pull cord assembly includes a handgrip 41 as described above, and the second connector subassembly 4 is secured to a fixture placed on the floor. Additionally, the pull cord assembly according to this invention may be used with other exercising devices, such as an elongated handle rod, an exercise ball, an exercise ring, a seat, rollers, and the like.

Figure 14:
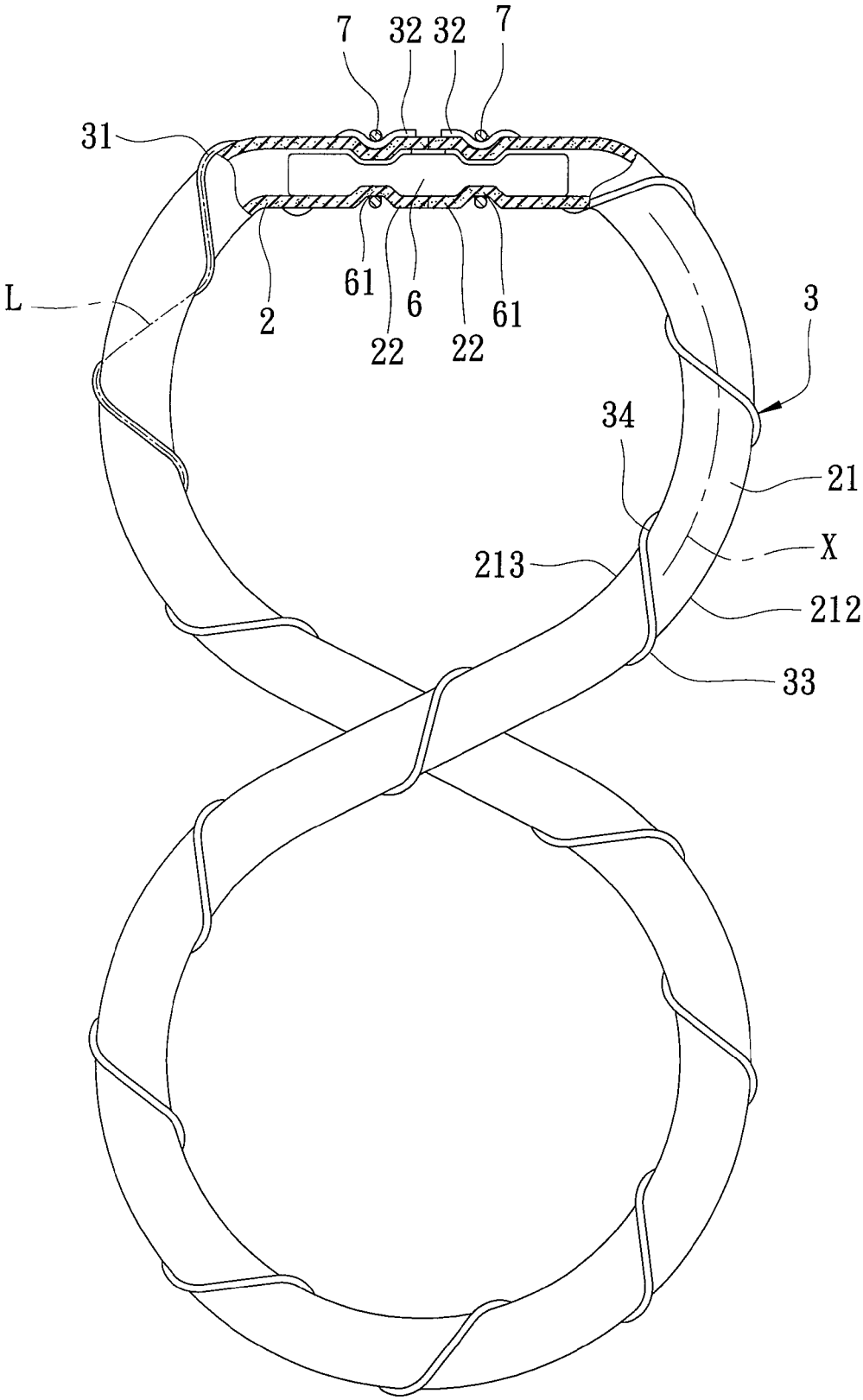
FIG. 14 is a partly sectional view of the sixth preferred embodiment of a pull cord assembly according to this invention.

Referring to FIG. 14, the sixth preferred embodiment of a pull cord assembly according to this invention is similar to the first embodiment in construction. In the sixth embodiment, instead of the first and second connector subassemblies, the pull cord assembly comprises a plug 6 which has two neck segments 61, and which is configured to be inserted into the tubular first and second anchored ends 22 of the elastic cord member 2 such that the neck segments 61 are respectively located in the tubular first and second anchored ends 22, and two tying bands 7, each of which is disposed to tie a respective one of the first and second coupled ends 32 to a corresponding one of the first and second anchored ends 22 around a corresponding one of the neck segments 61.

Figure 15:
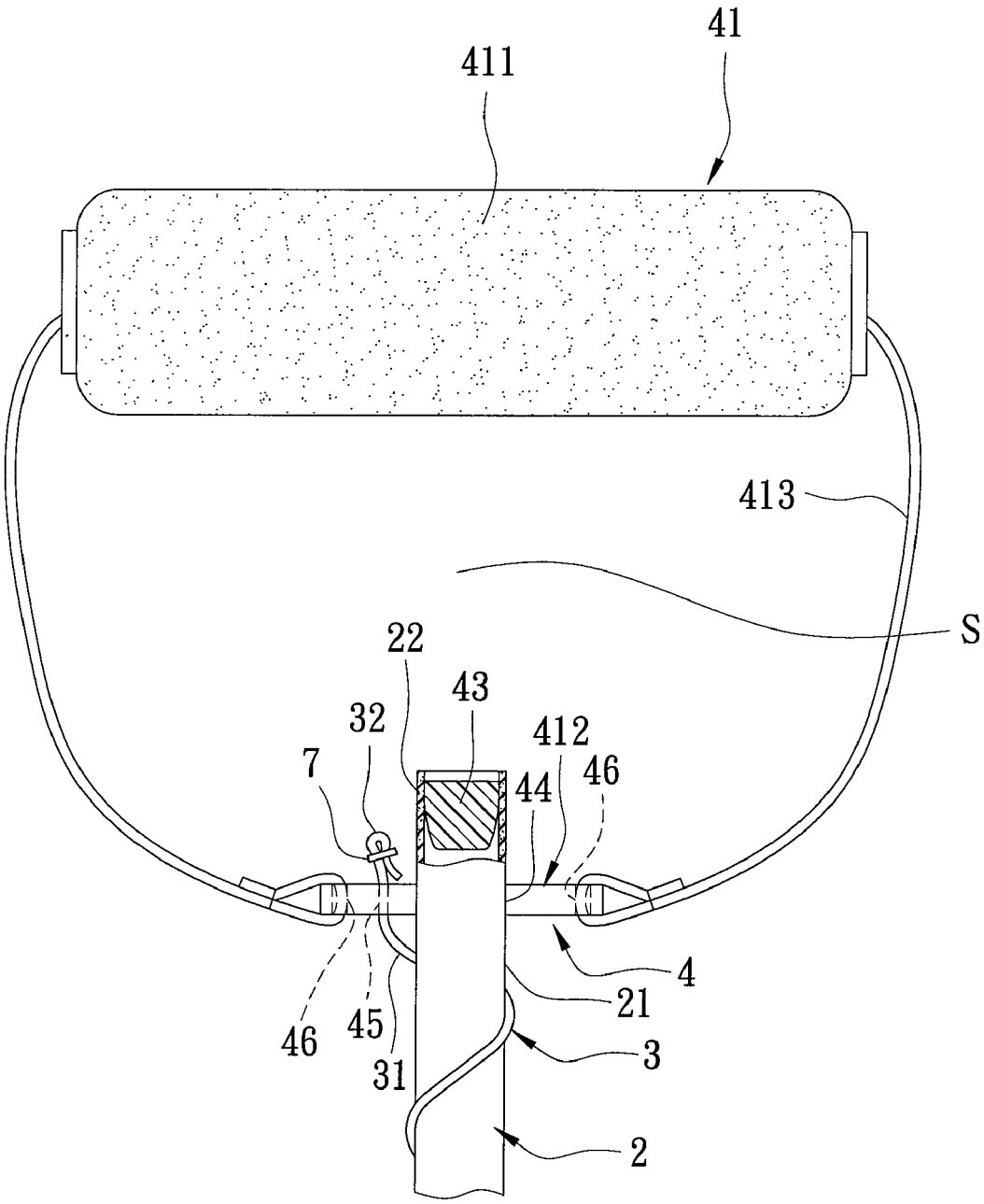
FIG. 15 is a fragmentary partly sectional view of the seventh preferred embodiment of a pull cord assembly according to this invention.

Referring to FIG. 15, the seventh preferred embodiment of a pull cord assembly according to this invention is similar to the first embodiment in construction. In the seventh embodiment, the through hole unit has a smaller hole 45 configured to permit passage of the strand-like body 31 therethrough, and a larger hole 44 configured to permit passage of the elastic cord body 21 therethrough. In addition, each of the first and second connector subassemblies 4 includes a tying band 7 which is disposed to tie a respective one of the first and second coupled ends 32 into a knot such that the respective one of the first and second coupled ends 32 cannot slip through the smaller hole 45 to move away from the handgrip space (S). The handgrip bar 411 is coupled to the crosspiece 412 via two straps 413 that have ends extending respectively through two holes 46 formed in the crosspiece 412. Alternatively, the tying band 7 is dispensed with, and each of the first and second connector subassemblies 4 may include a sub-plug (not shown) which is fitted snugly in a respective one of the first and second coupled ends 32 to enlarge the respective coupled end 32 so as to prevent the coupled end 32 from moving away from the handgrip space (S).

Figure 16:
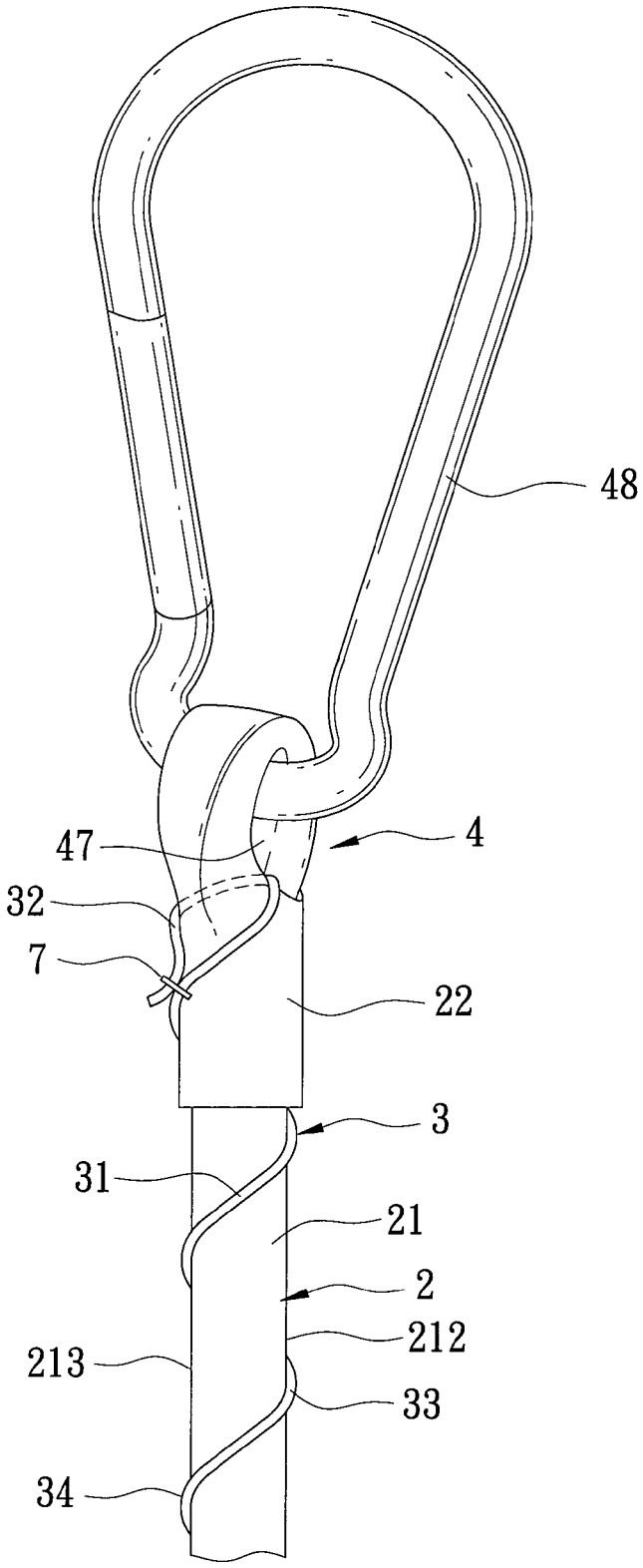
FIG. 16 is fragmentary perspective view of the eighth preferred embodiment of a pull cord assembly according to this invention.

Referring to FIG. 16, the eighth preferred embodiment of a pull cord assembly according to this invention is similar to the first embodiment in construction. In the seventh embodiment, each of the first and second connector subassemblies 4 includes a loop 47 which is integrally formed with a respective one of the first and second anchored ends 22 for threading of a respective one of the first and second coupled ends 32 through the loop 47, and a tying band 7 which is disposed to tie a respective one of the first and second coupled ends 32 to a respective one of the first and second anchored ends 22 so as to form a respective one of the secured first and second end pairs. In addition, each of the first and second connector subassemblies 4 includes a hook 48 connected to the loop 47.

Figure 17:
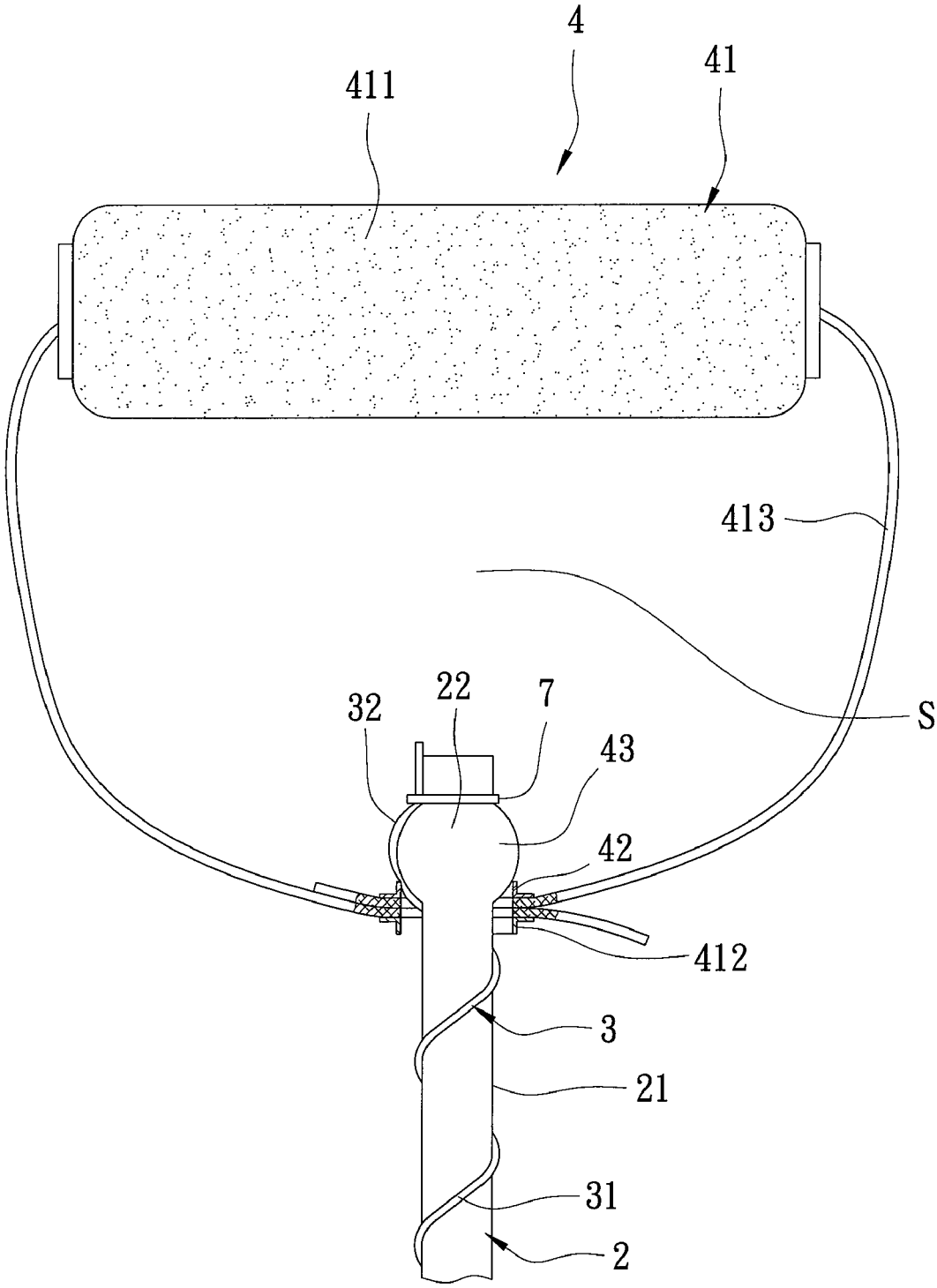
FIG. 17 is a fragmentary, partly sectional view of the ninth preferred embodiment of a pull cord assembly according to this invention.

Referring to FIG. 17, the ninth preferred embodiment of a pull cord assembly according to this invention is similar to the first embodiment in construction. In the ninth embodiment, the plug 43 of each of the first and second connector subassemblies 4 is integrally formed with a respective one of the first and second anchored ends 22. Each of the first and second connector subassemblies 4 further includes a tying band 7 which is disposed to tie a respective one of the first and second coupled ends 32 to the plug 43. The handgrip bar 411 is coupled to the crosspiece 412 via two straps 413.

Figure 18:
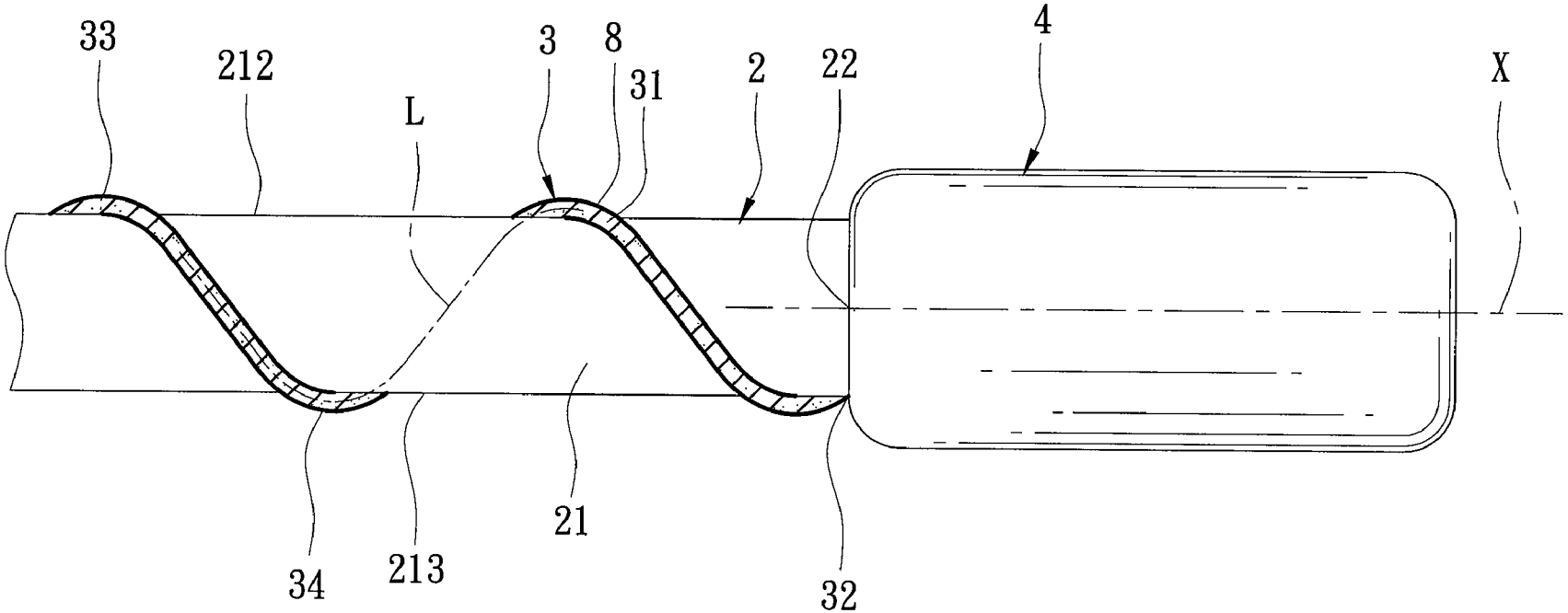
FIG. 18 is a fragmentary schematic view of a portion of the tenth preferred embodiment of a pull cord assembly according to this invention.

Referring to FIG. 18, the tenth preferred embodiment of a pull cord assembly according to this invention is similar to the first embodiment in construction. In the tenth embodiment, the pull cord assembly further comprises a flexible knitting layer 8 disposed to enclose the strand-like body 31.

Figure 19:
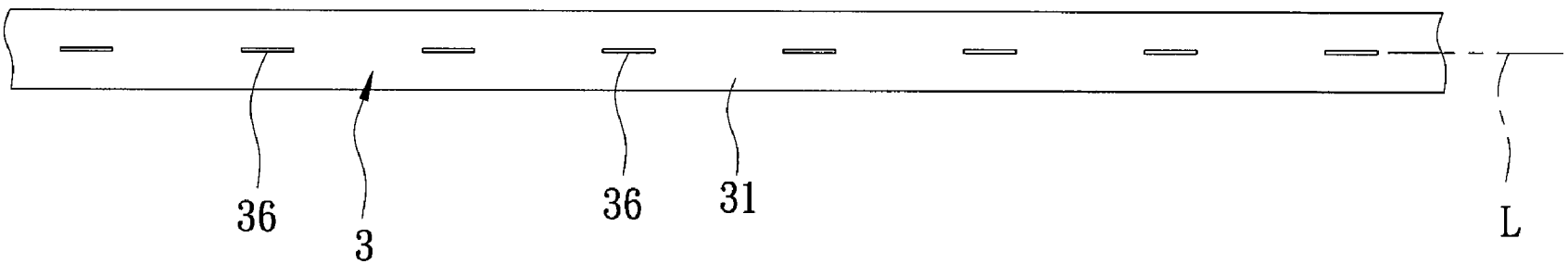
FIG. 19 is a fragmentary schematic view of a strand-like protective member of the eleventh preferred embodiment of a pull cord assembly according to this invention.
Figure 20:
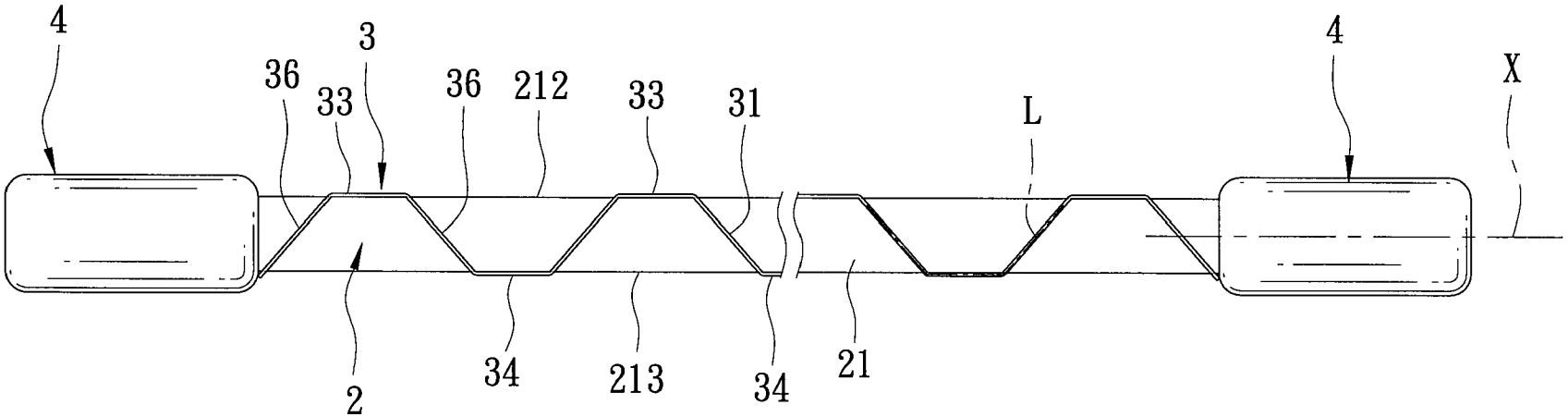
FIG. 20 is a fragmentary schematic view of the eleventh preferred embodiment.

Referring to FIGS. 19 and 20, the eleventh preferred embodiment of a pull cord assembly according to this invention is similar to the first embodiment in construction. In the eleventh embodiment, the strand-like protective member 3 is in the form of a flat band, and the strand-like body 31 of the strand-like protective member 3 has a plurality of threading holes 36 which are displaced from one another and which are arranged along the lengthwise length (L) for threading of the elastic cord body 21 therethrough such that each of the first segments 33 and an adjacent one of the second segments 34 are spaced apart from each other by a respective one of the threading holes 36.

Figure 21:
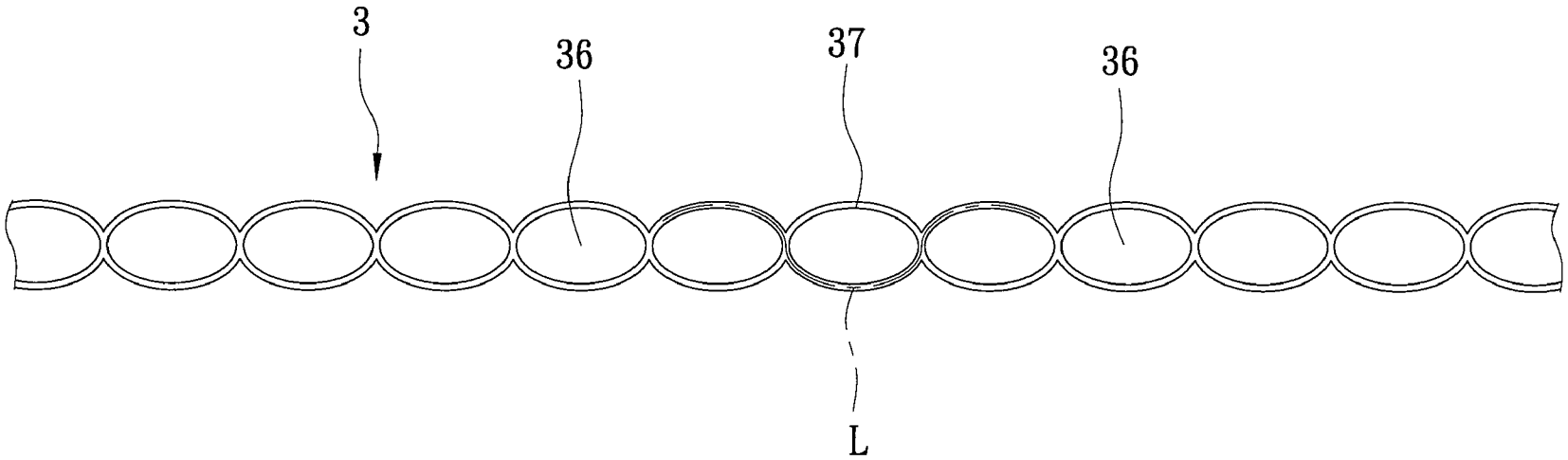
FIG. 21 is fragmentary schematic view of a strand-like protective member of the twelfth preferred embodiment of a pull cord assembly according to this invention.
Figure 22:
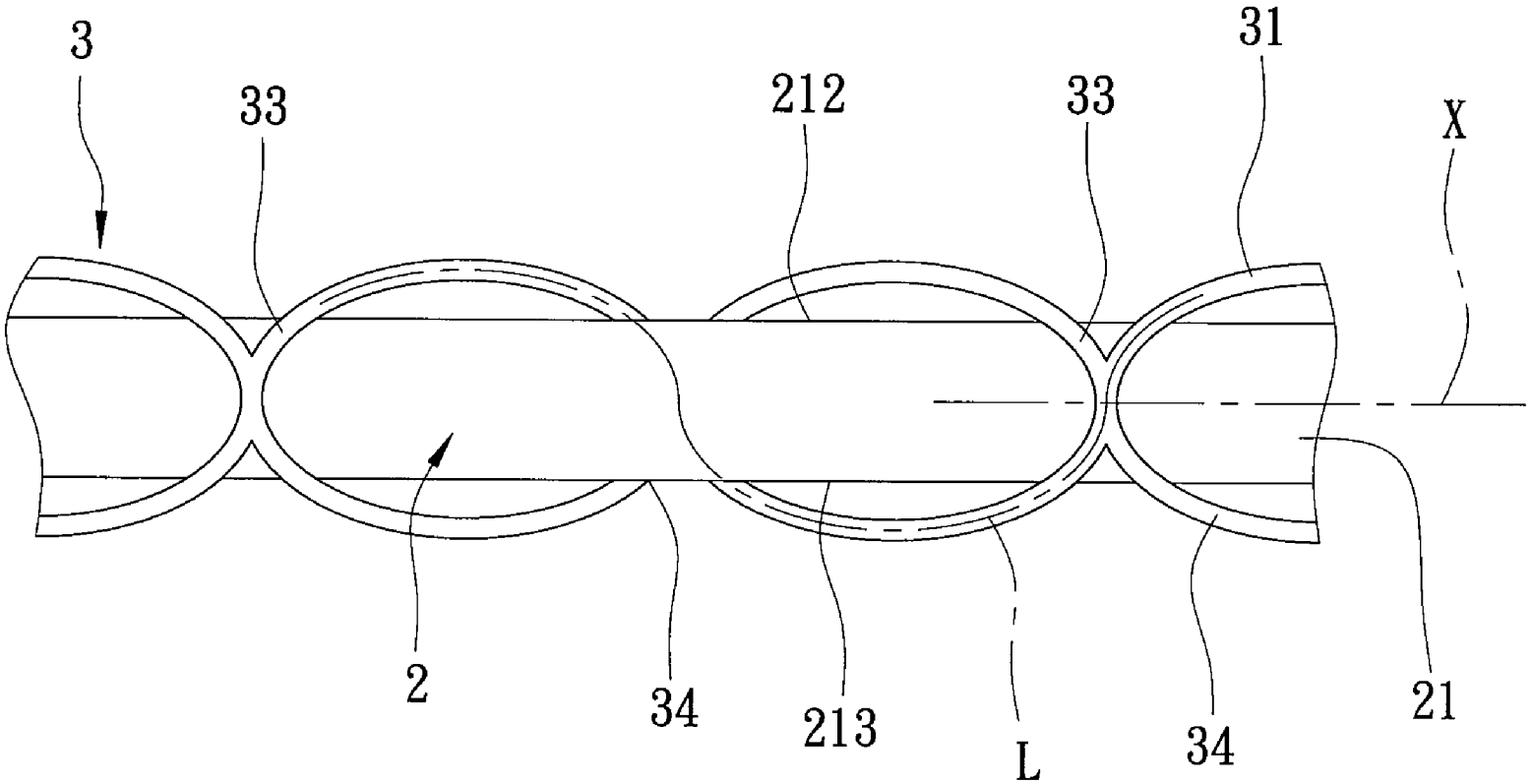
FIG. 22 is a fragmentary schematic view of the twelfth preferred embodiment.

Referring to FIGS. 21 and 22, the twelfth preferred embodiment of a pull cord assembly according to this invention is similar to the eleventh embodiment in construction. In the twelfth embodiment, the strand-like body 31 of the strand-like protective member 3 includes a plurality of loops 37 which engage one another and which respectively define the threading holes 36.

As illustrated, by providing the strand-like protective member 3 which has the strand-like body 31 twined around the elastic cord body 21 of the elastic cord member 2, if the elastic cord body 21 snaps, the elastic cord body 21 will snap back along a non-straight path (e.g., a spiral or helical path), thereby slowing down the movement of the elastic cord body 21 and reducing the impact of the elastic cord body 21 on the user.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

I claim:

1. A pull cord assembly for body stretching exercise, comprising:

an elastic cord member having an elastic cord body which extends along a lengthwise axis to terminate at first and second anchored ends, and which has an outer layer that surrounds the lengthwise axis and that has upper and lower halves opposite to each other relative to the lengthwise axis, said elastic cord body being stretchable along the lengthwise axis between a non-stretched state, where said elastic cord body has a normal length, and a stretched state, where said elastic cord body has an extended length; and a strand-like protective member having a strand-like body which extends lengthwise to terminate at a first coupled end that is secured with said first anchored end to form a secured first end pair, and a second coupled end that is secured with said second anchored end to form a secured second end pair, said strand-like body having a plurality of first segments which are respectively displaced from one another along a lengthwise length of said strand-like body, and a plurality of second segments which are displaced from one another along the lengthwise length, each of said first segments being alternately disposed with a respective one of said second segments, said strand-like body being configured to be twined around said elastic cord body along the lengthwise axis such that said first and second segments are respectively disposed on said upper and lower halves, such that said first segments are displaced from one another along the lengthwise axis, and such that said second segments are displaced from one another along the lengthwise axis, said strand-like body being further disposed in abutting engagement with said elastic cord body along the lengthwise length thereof when said elastic cord body is in the non-stretched state such that, when said elastic cord is subjected to a stretching force, said first and second segments are pulled and straightened along the lengthwise axis, thereby bringing said first and second segments to tightly abut against said upper and lower halves, respectively; wherein said strand-like body is made from an elastic material, and has a normal strand length when said elastic cord body is in the non-stretched state, the normal strand length being smaller than the normal length of said elastic cord body.

2. The pull cord assembly according to claim 1, wherein said first segments are connected to said second segments in a continuous manner such that said strand-like body has a single-piece construction.

3. The pull cord assembly according to claim 1, further comprising a first connector subassembly disposed to secure said first coupled end to said first anchored end, and a second connector subassembly disposed to secure said second coupled end to said second anchored end.

4. The pull cord assembly according to claim 3, wherein each of said first and second connector subassemblies includes a handgrip having a handgrip bar which is disposed distal from a respective one of said first and second end pairs, and a crosspiece which is spaced apart from said handgrip bar along the lengthwise axis by a handgrip space, and which has a through hole unit extending along the lengthwise axis and configured to permit at least one of said strand-like and elastic cord bodies to pass therethrough such that a respective one of said first and second end pairs is disposed in said handgrip space.

5. The pull cord assembly according to claim 4, wherein said through hole unit is configured to permit passage of said strand-like and elastic cord bodies therethrough, each of said first and second connector subassemblies further including a plug which is configured to be fitted snugly in a respective one of said first and second anchored ends such that the respective one of said first and second anchored ends is enlarged so as to prevent movement of a respective one of said first and second end pairs away from said handgrip space.

6. The pull cord assembly according to claim 5, wherein said through hole unit has a smaller hole configured to permit passage of said strand-like body therethrough, and a larger hole configured to permit passage of said elastic cord body therethrough.

7. The pull cord assembly according to claim 5, wherein said plug has a fastening hole for securing a respective one of said first and second coupled ends.

8. The pull cord assembly according to claim 5, wherein each of said first and second connector subassemblies includes a tying band which is disposed to tie a respective one of said first and second coupled ends to the respective one of said first and second anchored ends.

9. The pull cord assembly according to claim 6, wherein each of said first and second connector subassemblies includes a tying band which is disposed to tie a respective one of said first and second coupled ends into an enlarged knot so as to prevent the respective one of said first and second coupled ends from slipping through said smaller hole and moving away from said handgrip space.

10. The pull cord assembly according to claim 5, wherein said plug is integrally formed with a respective one of said first and second anchored ends, each of said first and second connector subassemblies including a tying band which is disposed to tie a respective one of said first and second coupled ends to said plug.

11. The pull cord assembly according to claim 1, wherein said first and second anchored ends are tubular, said pull cord assembly further comprising a plug which has two neck segments, and which is configured to be inserted into said first and second anchored ends such that said neck segments are respectively located in said first and second anchored ends, and two tying bands, each of which is disposed to tie a respective one of said first and second coupled ends to a corresponding one of said first and second anchored ends around a corresponding one of said neck segments.

12. The pull cord assembly according to claim 3, wherein each of said first and second connector subassemblies includes a loop which is integrally formed with a respective one of said first and second anchored ends for threading of a respective one of said first and second coupled ends through said loop, and a tying band which is disposed to tie a respective one of said first and second coupled ends to the respective one of said anchored ends to form a respective one of said first and second end pairs.

13. The pull cord assembly according to claim 1, further comprising a flexible knitting layer disposed to enclose said strand-like body.

14. The pull cord assembly according to claim 1, wherein said strand-like body has a plurality of threading holes which are displaced from one another and which are arranged along the lengthwise length for threading of said elastic cord body therethrough such that each of said first segments and an adjacent one of said second segments are spaced apart from each other by a respective one of said threading holes.

15. The pull cord assembly according to claim 1, wherein said strand-like body includes a plurality of loops which engage one another and which respectively define said threading holes.

16. The pull cord assembly according to claim 1, wherein said strand-like body is disposed to be twined around said elastic cord body such that the lengthwise length extends in a spiral path that surrounds the lengthwise axis.

17. The pull cord assembly according to claim 16, further comprising an auxiliary strand-like protective member having an auxiliary strand-like body which is disposed to be twined around said elastic cord body along a secondary spiral path that surrounds the lengthwise axis and that is opposite to the spiral path.

18. The pull cord assembly according to claim 16, wherein said strand-like body includes three strands which are intertwined together.

19. The pull cord assembly according to claim 1, further comprising a protective sleeve which is shiftably sleeved on said strand-like body.

20. The pull cord assembly according to claim 1, wherein said strand-like body is thinner than said elastic cord body.

21. A pull cord assembly for body stretching exercise, comprising: an elastic cord member having an elastic cord body which extends along a lengthwise axis to terminate at first and second anchored ends, and which has an outer layer that surrounds the lengthwise axis and that has upper and lower halves opposite to each other relative to the lengthwise axis, said elastic cord body being stretchable along the lengthwise axis between a non-stretched state, where said elastic cord body has a normal length, and a stretched state, where said elastic cord body has an extended length; and a strand-like protective member having a strand-like body which extends lengthwise to terminate at a first coupled end that is secured with said first anchored end to form a secured first end pair, and a second coupled end that is secured with said second anchored end to form a secured second end pair, said strand-like body having a plurality of first segments which are respectively displaced from one another along a lengthwise length of said strand-like body, and a plurality of second segments which are displaced from one another along the lengthwise length, each of said first segments being alternately disposed with a respective one of said second segments, said strand-like body being configured to be twined around said elastic cord body along the lengthwise axis such that said first and second segments are respectively disposed on said upper and lower halves, such that said first segments are displaced from one another along the lengthwise axis, and such that said second segments are displaced from one another along the lengthwise axis, said first and second segments being nonwoven with respect to each other, said strand-like body being further disposed in abutting engagement with said elastic cord body along the lengthwise length thereof when said elastic cord body is in the non-stretched state such that, when said elastic cord is subjected to a stretching force, said first and second segments are pulled and straightened along the lengthwise axis, thereby bringing said first and second segments to tightly abut against said upper and lower halves, respectively.

* * * * *